US005547193A

United States Patent [19]

Sander

[11] Patent Number: 5,547,193

[45] Date of Patent: Aug. 20, 1996

[54] GOLF CLUB COVER

[75] Inventor: Robert F. Sander, Dallas, Tex.

[73] Assignee: Sports Systems Inc., Plano, Tex.

[21] Appl. No.: 224,810

[22] Filed: Apr. 8, 1994

Related U.S. Application Data

[63] Continuation-in-part of Ser. No. 1,152, Nov. 3, 1992, abandoned.

[51] Int. Cl.[6] ..... A63B 57/00

[52] U.S. Cl. ..... 473/252; 150/160

[58] Field of Search ..... 273/32 R, 162 R; 150/160; 206/315.2, 315.4

[56] References Cited

U.S. PATENT DOCUMENTS

| | | | |
|---|---|---|---|
| D. 273,968 | 5/1984 | Masai et al. | D21/221 |
| 3,965,955 | 6/1976 | Price | 150/160 |
| 5,050,884 | 9/1991 | Flory | 273/162 R |
| 5,284,194 | 2/1994 | Gaffney | 150/160 |

OTHER PUBLICATIONS

National Golf Distributors, Spring, 1991, p. 8, bottom left, Shaft Protector Headcover.

*Primary Examiner*—William H. Grieb
*Attorney, Agent, or Firm*—Harris, Tucker & Hardin, P.C.

[57] ABSTRACT

A golf club cover is comprised of a flexible cover member having a substantially cylindrical deformable body open at one end for receiving the head portion of a golf club and an essentially tubular member depending from the flexible cover member for receiving the shaft portion of the club. The tubular member is open at both ends and has a slot extending between the open ends. The shaft portion of the club is insertable into the tubular member by penetrating movement of the shaft portion through the slot in a direction generally transverse to a longitudinal axis of the shaft portion. The tubular member has flared first and second edge portions on respective opposite sides of the slot for urging the shaft portion through the slot. The tubular member has a predetermined resiliency such that first and second edge portions are laterally spreadable by the penetrating movement of the shaft portion through the slot.

11 Claims, 4 Drawing Sheets

GOLF CLUB COVER

CROSS-REFERENCE TO RELATED APPLICATION

This application is a continuation-in-part of application Ser. No. 29/001,152, filed Nov. 3, 1992, now abandoned.

FIELD OF THE INVENTION

This invention relates generally to golf club covers and in particular to an improved golf club cover for covering both the head and shaft portions of a golf club.

BACKGROUND ART

Golf club covers of various types are known in the art. One type of cover is made in the form of an inverted pouch which fits loosely over the golf club head, but does not cover the club shaft. Another type of cover includes a flexible sock-like shaft cover portion depending from the head cover portion for covering the club shaft. The cover is applied to the golf club by placing the shaft cover portion over the club head and then pulling the shaft cover portion downwardly along a longitudinal axis of the club shaft so that the shaft cover portion is pulled over the club head and then onto the club shaft. A bottom part of the shaft cover portion is preferably flared to accommodate the club head.

The process of applying the cover is cumbersome and inconvenient because the club head must be pulled through shaft cover portion before the club shaft can be received in the shaft cover portion. There is therefore a need for an improved golf club cover which can be applied easily and conveniently to both the head and shaft of a golf club.

DISCLOSURE OF THE INVENTION

In accordance with the present invention, a golf club cover is provided having a first cover member for receiving the head of the golf club and a second cover member depending from the first cover member for receiving the club shaft. The first cover member has an open end through which the club head is insertable into the first cover member. The second cover member is open at both ends and has a slot extending between the open ends which communicates with the interior of the shaft cover member. The shaft is insertable into the second cover member by penetrating movement of the club shaft through the slot in a direction generally transverse to a longitudinal axis of the club shaft.

In accordance with one feature of the invention, the second cover member is essentially tubular and has a substantially cylindrical wall terminating with flared first and second edge portions on respective opposite sides of the slot for urging the club shaft through the slot. Respective inner surfaces of the first and second edge portions are curved to facilitate penetration of the club shaft through the slot.

In accordance with another feather of the invention, the second cover member has a predetermined resiliency such that the first and second edge portions are laterally spreadable by penetrating movement of the club shaft through the slot. The width of the slot is insufficient to accommodate passage of the shaft therethrough without spreading the first and second, edge portions to widen the slot. The resiliency of the second cover member returns the first and second edge portions to their respective non-spread positions to capture at least an upper portion of the club shaft within the second cover member. The shaft portion is disengaged from the second cover member by exerting a force on the club shaft in a direction generally transverse to the longitudinal axis of the club shaft to spread the first and second edge portions sufficiently to allow the club shaft portion to be retracted from the second cover member through the slot in an opposite direction from the direction in which the club shaft was inserted into the second cover member.

In accordance with a preferred embodiment of the invention, the wall of the second cover member, including the first and second edge portions, is made of plastic and is covered inside and out with a soft flexible material (e.g., a synthetic fur-like material such that the wall is substantially and completely enveloped by the flexible material. The first cover member is also preferably made of the same soft flexible material. The flexible cover member has a closed end opposite from the open end thereof and a substantially cylindrical deformable body extending between the closed and open ends for fitting loosely over the club head. The second cover member is adapted to be applied directly to the club shaft. The flexible material is interposed between the plastic wall of the second cover member and the club shaft to prevent direct contact between the plastic wall and the club shaft.

BEST MODE FOR CARRYING OUT THE INVENTION

Figure 1:
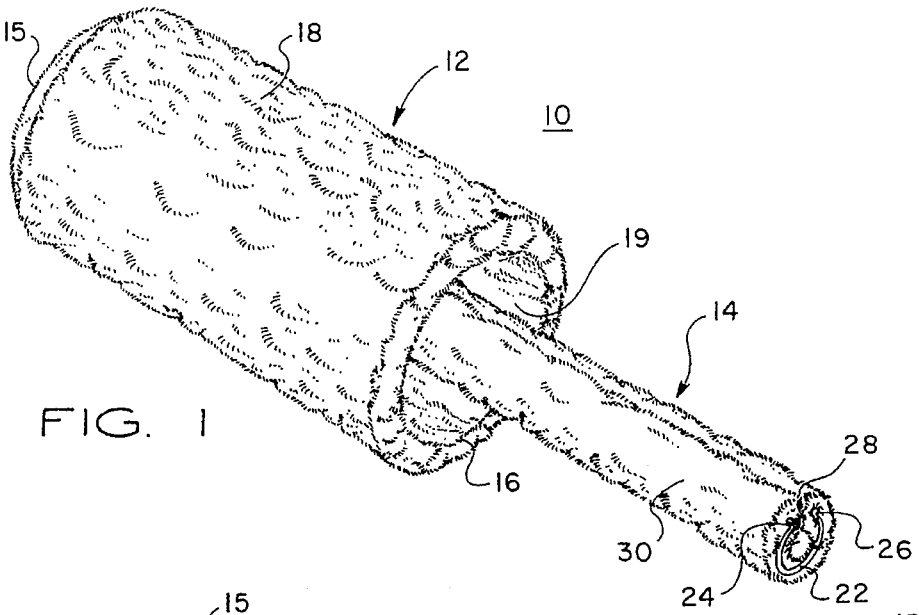
FIG. 1 is a perspective view of a golf club cover, according to the present invention.
Figure 2:
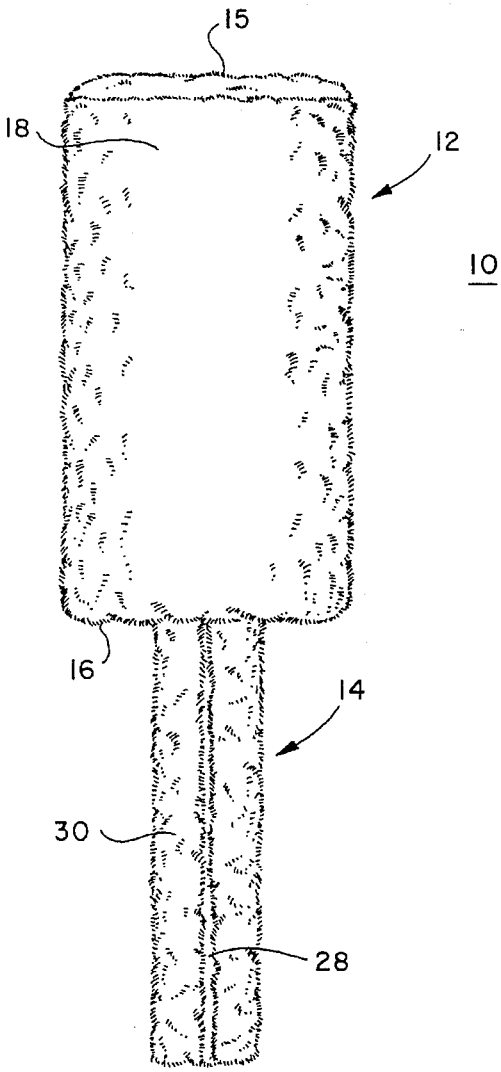
FIG. 2 is a front elevation view thereof.
Figure 3:
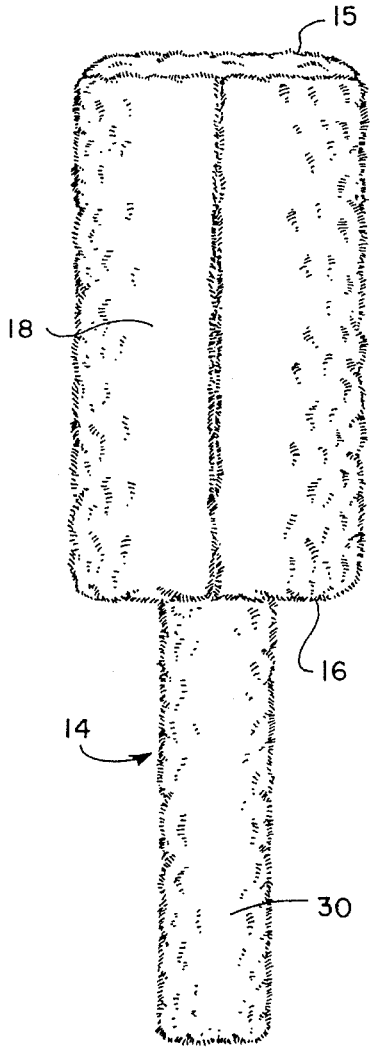
FIG. 3 is a rear elevation view thereof.
Figure 4:
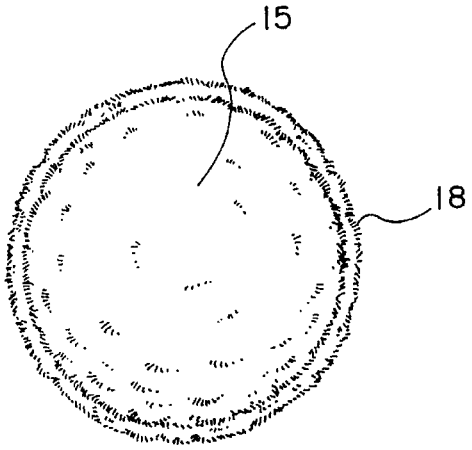
FIG. 4 is a top plan view thereof.
Figure 5:
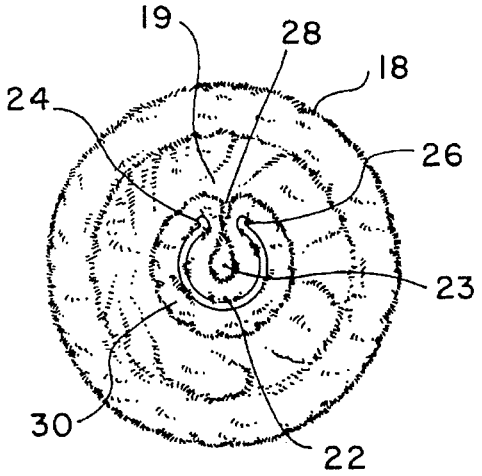
FIG. 5 is a bottom plan view thereof.
Figure 6:
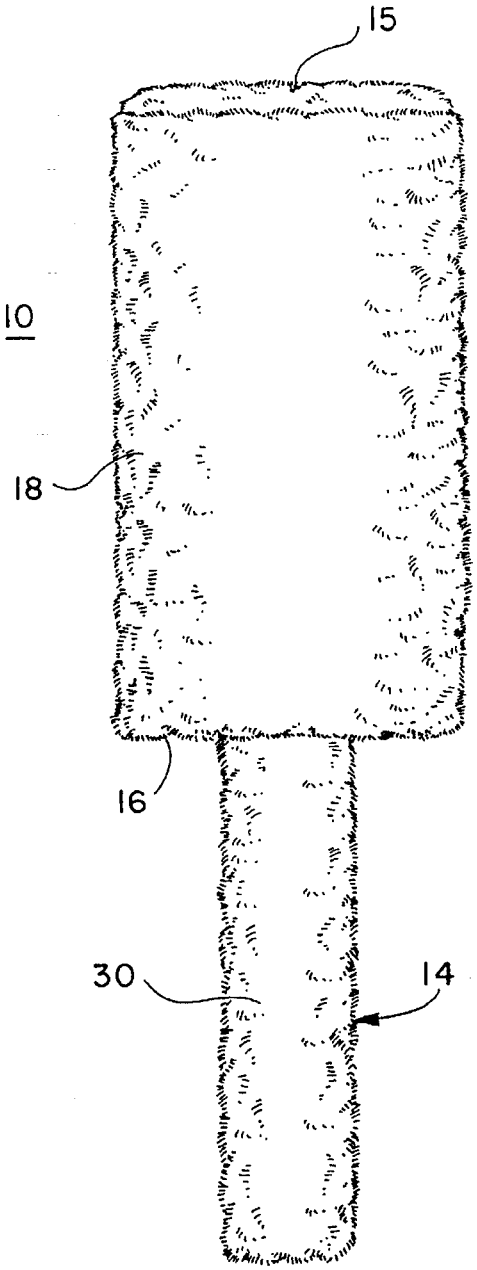
FIG. 6 is a side elevation view thereof.
Figure 7:
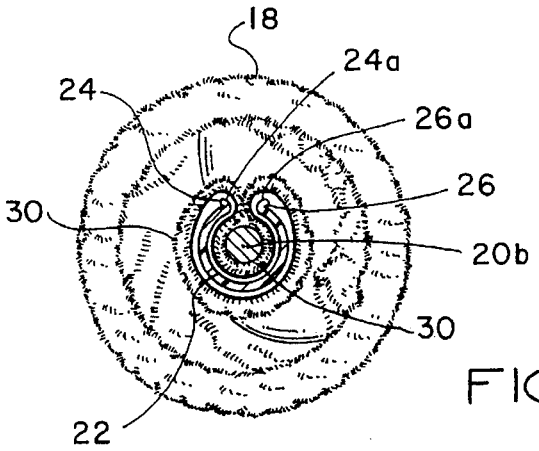
FIG. 7 is a bottom cross-sectional view thereof, showing the cover applied to a golf club shaft.

In the description which follows, like parts are marked throughout the specification and drawings with the same respective reference numerals. The drawings are not necessarily to scale and in some instances proportions may have been exaggerated in order to more clearly depict certain features of the invention.

Figure 8:
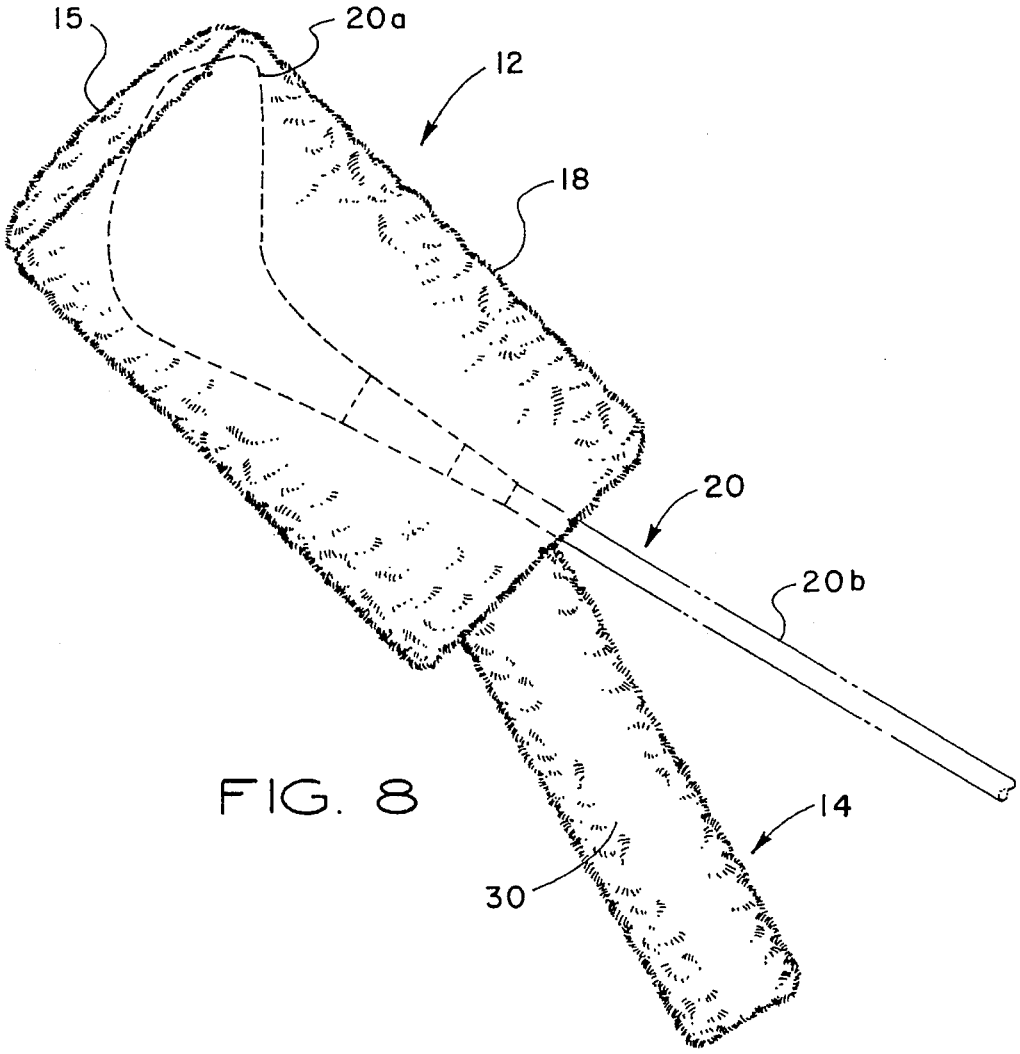
FIG. 8 is a perspective view of the golf club cover with the head portion of a golf club received therein.
Figure 9:
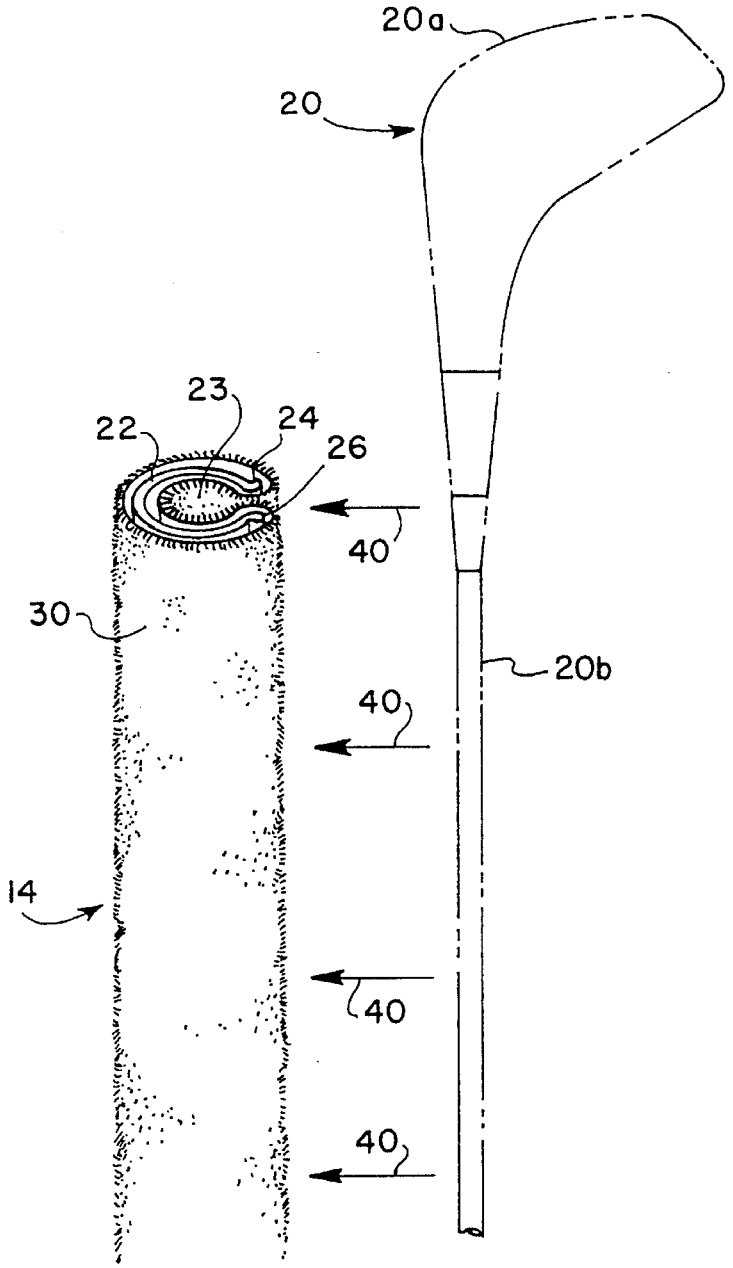
FIG. 9 is an elevation view showing the insertion of a golf club shaft into a shaft cover portion of the cover.
Figure 10A:
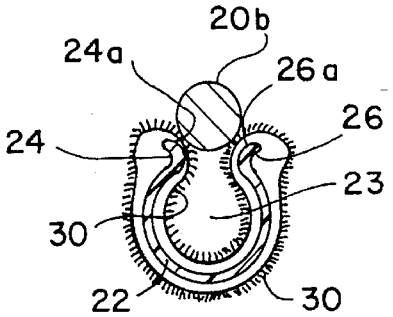
FIGS. 10A and 10B are cross-sectional views showing the insertion of the golf club shaft into the shaft cover portion.
Figure 10B:
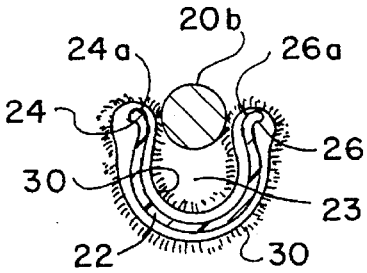

Referring to FIGS. 1–10, a golf club cover 10 according to the present invention includes a first cover member 12 and a second cover member 14 depending from first cover member 12. First cover member 12 is made of a soft, flexible material, such as a synthetic fur-like material. First cover member 12 has a closed end 15, an open end 16 in opposed relationship with closed end 14 and a substantially cylindrical deformable body 18 extending between closed and open ends 14 and 16. Closed end 14 and body 18 define a first enclosure 19 inside body 18 for receiving a head portion 20*a* of a golf club 20, as shown in FIG. 8.

Second cover member 14 is essentially tubular and includes a substantially cylindrical wall 22 made of a lightweight material such as plastic. Wall 22 is open at both ends and terminates with opposed first and second edge portions 24 and 26. Edge portions 24 and 26 define an elongated slot 28, which extends between the open ends of second cover member 14.

Wall 22 defines a second enclosure 23 inside of wall 22 for receiving at least the upper part of shaft portion 20*b* of golf club 20. The length of shaft portion 20*b* covered by second cover member 14 depends on the length of second cover member 14. Wall 22 is lined both inside and outside with a soft flexible material 30 such as the synthetic fur-like material of which first cover member 12 is made. As can be best seen in FIGS. 5 and 7, the flexible material 30 substantially envelopes wall 22. Inner surfaces 24*a* and 26*a* of respective first and second edge portions 24 and 26 are curved and edge portions 24 and 26 are flared to facilitate the penetration of shaft portion 20*b* through slot 28. Curved surfaces 24*a* and 26*a* urge shaft portion 20*b* through slot 28 and into second enclosure 23. The width of slot 28 is not normally sufficient to accommodate the insertion of shaft portion 20*b*. In order to accommodate shaft portion 20*b*, first and second edge portions 24 and 26 must be spread apart to widen slot 28. This is accomplished by exerting a force on shaft portion 20*b* to move shaft portion 20*b* in a direction generally transverse to a longitudinal axis of shaft portion 20*b*, which is also generally transverse to a longitudinal axis of slot 28, as can be best seen in FIG. 9. Shaft portion 20*b* is inserted into enclosure 23 by first bringing shaft portion 20*b* into pressure engagement with inner surfaces 24*a* and 26*a*, as can be best seen in FIG. 10A. Wall 22 has a predetermined resiliency, such that the penetrating movement of shaft portion 20*b* through slot 28 spreads first and second edge portions 24 and 26 apart to widen slot 28 and allow shaft portion 20*b* to penetrate through slot 28 into enclosure 23, as can be best seen in FIG. 10B. After shaft portion 20*b* has penetrated through slot 28, the resiliency of tubular member 22 returns first and second edge portions 24 and 26 to their respective non-spread positions, thereby retaining shaft portion 20*b* snugly within enclosure 23, as can be best seen in FIG. 7.

In order to disengage shaft portion 20*b* from second cover member 14, a force is exerted to move shaft portion 20*b* in an opposite direction from the direction in which shaft portion 20*b* was inserted into enclosure 23, thereby bringing shaft portion 20*b* into pressure engagement with surfaces 24*a* and 26*a* and spreading first and second edge portions 24 and 26 to allow shaft portion 20*b* to be disengaged from second cover member 14.

One skilled in the art will recognize that first cover member 12 and second cover member 14 may be applied independently to head portion 20*a* and shaft portion 20*b*, respectively. Second cover member 14 is adapted to be applied directly to shaft portion 20*b* without having to first pull second cover member 14 over head portion 20*b*, as is required in prior art golf club covers having shaft cover portions. By the same token, first cover member 12 may be applied to head portion 20*a* without having to apply second cover member 14 to shaft portion 20*b*. When second cover member 14 is applied to shaft portion 20*b*, shaft portion 20*b* is retained securely within second cover member 14. The flexible lining material 30 is interposed between shaft portion 20*b* (which is preferably of a lightweight material such as aluminum or graphite) and the plastic material of wall 22, thereby protecting shaft portion 20*b* against damage. Second cover member 14 is engageable with shaft portion 20*b* by moving second cover member 14 or shaft portion 20*b*, or both of them, in a direction generally transverse to the respective longitudinal axes of shaft portion 20*b* and slot 28, as indicated by arrows 40 in FIG. 9, so that shaft portion 20*b* snaps into second cover member 14 by penetrating movement of shaft portion 20*b* through slot 28.

Various embodiments of the invention have now been described in detail. Since changes in and/or additions to the above-described best mode may be made without departing from the nature, spirit and scope of the invention, the invention is not to be limited to the above-described embodiments.

What is claimed is:

1. A combination golf club head cover and shaft protector, comprising:

a first cover member having a first enclosure for receiving a head portion of a golf club, said first cover member having an open end through which the head portion is insertable into said first enclosure;

a second cover member depending from said first cover member, having a second enclosure having a C-shaped member for receiving a shaft portion of the golf club, said second cover member having an elongated slot communicating with said second enclosure, the shaft portion being insertable into the second enclosure through said slot; and said first cover member being radially enlarged with respect to said second cover member.

2. The cover and shaft protector of claim 1 wherein the first cover member is radially enlarged at least several times the diameter of the second cover member.

3. The cover and shaft protector of claim 2 wherein the material of which the second cover member is made is wrapped around said C-shaped member and is present inside said second enclosure.

4. The cover and shaft protector of claim 2 wherein the depending second cover member can be tilted at an angle with respect to the first cover member to expose an unobstructed portion of the open end of the first cover member for insertion of the head of a golf club into said first enclosure.

5. The cover and shaft protector of claim 3 wherein said C-shaped member has opposed flared first and second edge portions to create an entrance to said second enclosure and help define said elongated slot.

6. The cover and shaft protector of claim 5 wherein the depending second cover member can be tilted at an angle with respect to the first cover member to expose an unobstructed portion of the open end of the first cover member for insertion of the head of a golf club into said first enclosure.

7. A combination golf club head cover and shaft protector, comprising:

a substantially cylindrical first material cover member;

a substantially cylindrical second material cover member depending from said first cover member, said second material cover member having an elongated slot and a C-shaped member, said C-shaped member comprising a material different from the material of said second material cover member;

said elongated slot being capable of receiving the shaft of a golf club;

said first material cover member being radially enlarged with respect to said second material cover member and having an open end through which the head of a golf club is insertable.

8. The cover and shaft protector of claim 7 wherein the first material cover member is radially enlarged at least several times the diameter of the second material cover member.

9. The cover and shaft protector of claim 8 wherein the material of the second cover member is present inside and outside said C-shaped member.

10. The cover and shaft protector of claim 9 wherein the first material cover member has a first enclosure for receiving a head of a golf club inserted through said open end and the inside of said C-shaped member has a second enclosure communicating with said elongated slot for receiving the shaft portion of the golf club through said slot.

11. The cover and shaft protector of claim 10 wherein the depending second material cover member can be tilted at an angle with respect to the first material cover member to expose an unobstructed portion of said open end for insertion of said head of a golf club into said first enclosure.

* * * * *